US011643779B2

(12) United States Patent
Gingras et al.

(10) Patent No.: US 11,643,779 B2
(45) Date of Patent: May 9, 2023

(54) REFINER PLATE HAVING GROOVES IMPARTING ROTATIONAL FLOW TO FEED MATERIAL

(71) Applicant: Andritz Inc., Alpharetta, GA (US)

(72) Inventors: Luc Gingras, Harrogate (GB); Marc Berger, Lachine (CA)

(73) Assignee: ANDRITZ INC., Alpharetta, GA (US)

( * ) Notice: Subject to any disclaimer, the term of this patent is extended or adjusted under 35 U.S.C. 154(b) by 275 days.

(21) Appl. No.: 17/081,693

(22) Filed: Oct. 27, 2020

(65) Prior Publication Data

US 2021/0180253 A1 Jun. 17, 2021

Related U.S. Application Data

(60) Provisional application No. 62/947,741, filed on Dec. 13, 2019.

(51) Int. Cl.
*B02C 7/12* (2006.01)
*D21D 1/30* (2006.01)

(52) U.S. Cl.
CPC ..... *D21D 1/306* (2013.01); *B02C 7/12* (2013.01)

(58) Field of Classification Search
CPC ..... B02C 7/12; D21D 1/30; D21D 1/306
See application file for complete search history.

(56) References Cited

U.S. PATENT DOCUMENTS 3,473,745 A * 10/1969 Soars, Jr. ..... D21D 1/30 241/298
5,373,995 A * 12/1994 Johannson ..... D21D 1/306 241/261.3
5,439,183 A * 8/1995 Virving ..... B02C 7/12 241/261.3
5,823,453 A * 10/1998 Garasimowicz ..... D21D 1/306 241/261.3
5,836,525 A 11/1998 Garnier et al.
6,032,888 A 3/2000 Deuchars
6,607,153 B1 * 8/2003 Gingras ..... B02C 7/12 241/261.3
9,708,765 B2 7/2017 Gingras
2002/0070303 A1 * 6/2002 Johansson ..... B02C 7/12 241/261.3
2006/0151648 A1 * 7/2006 Vuorio ..... D21D 1/30 241/261.2
2007/0210197 A1 * 9/2007 Carpenter ..... B02C 7/12 241/298
2010/0314476 A1 * 12/2010 Vuorio ..... D21D 1/22 241/291

(Continued)

OTHER PUBLICATIONS

Jones, Trevor Frank, "Swirl-Inducing Ducts," IntechOpen, <http://dx.doi.org/10.5772/intechopen.78959>.

(Continued)

*Primary Examiner* — Faye Francis

(74) *Attorney, Agent, or Firm* — Kilpatrick Townsend & Stockton LLP

(57) ABSTRACT

A refiner disc including: a refining zone on a front face of the disc; refining bars in the refining zone; and grooves between the bars, wherein each of the grooves include a rotational inducement element arranged on at least one sidewall of the groove and the rotational inducement element is configured to impart at helical flow of feed material flowing through the groove.

37 Claims, 7 Drawing Sheets

(56) References Cited

U.S. PATENT DOCUMENTS

| | | | | |
|---|---|---|---|---|
| 2019/0145048 | A1* | 5/2019 | Lindblom | D21D 1/306<br>162/261 |
| 2022/0034035 | A1* | 2/2022 | Gingras | B02C 7/12 |
| 2022/0145537 | A1* | 5/2022 | Vuorio | D21D 1/004 |

OTHER PUBLICATIONS

European Application No. EP20209175.7, Extended European Search Report dated Apr. 20, 2021, 6 pages.

* cited by examiner

REFINER PLATE HAVING GROOVES IMPARTING ROTATIONAL FLOW TO FEED MATERIAL

CROSS-RELATED APPLICATION

This application claims the benefit under 35 U.S.C. § 119(e) of the earlier filing date of U.S. Provisional Patent Application No. 62/947,741 filed on Dec. 13, 2019, the entire contents of which is incorporated herein by reference.

BACKGROUND OF THE INVENTION

Technical Field

The present disclosure relates generally to refiner discs used to mechanically refine wood chips and other feed material into pulp, and, particularly, relates to the grooves between bars on the refining surfaces of the discs.

RELATED ART

The front face of a refiner disc has an annular refining zone which includes bars and grooves. The bars and grooves refine by acting on the feed material flowing between the opposing front faces of a pair of refiner discs in a refiner. As one or both of the opposing discs rotate, the bars of one disc repeatedly cross and uncross the bars of the other disc. The crossing of bars create strong pulsating compressive and shear forces applied to the feed material between the bars. The compressions and shearing separate the feed material into fibers, such as separating wood chips into lignocellulosic fibers. The fiber separation in the refiner is a step in transforming wood chips into pulp suitable for making boards, paper or other products formed from pulp.

The grooves between the bars form passages through which flows feed material, water, steam and material carried by the feed material. The grooves assist in moving the feed material and associated fluids and material between the opposing refiner discs and through the refiner.

There is an undesirable tendency of feed material remaining too long in the grooves. While in the grooves, the feed material is not subject to the pulsating compressive and shearing forces applied to feed material moving over the bars. Feed material which stays too long in the grooves may not be fully refined and separated into fibers when the material is discharged from the refiner. Thus, there is a long felt need to reduce the periods that feed material is in the grooves.

To prevent feed material remaining too long in the grooves, dams are placed in the grooves and the sides of grooves (which are the sidewalls of the bars) are serrated or formed with jagged edges. The dams force feed material out of the grooves and towards the ridges of the bars. Similarly, serrated and jagged sidewalls have sloped surfaces to move the feed material from the grooves and towards the ridges. Examples of grooves with dams and sides with serrated or jagged surfaces are disclosed in U.S. Pat. Nos. 9,708,765; 9,604,221; 8,157,195; 7,900,862, and 6,032,888.

The dams and serrated and jagged sidewalls disrupt the flow of material through the grooves and cause excessive turbulence in the flow. Eddy currents may form in grooves just upstream or downstream of the dams. Similarly, eddy currents may form in the corners of serrated and jagged sidewalls of the bars. These eddy currents tend to capture feed material and hold the material in the grooves.

There remains a long felt need to more effectively move feed material out of grooves. The need is also to avoid creating pockets of eddy currents in the grooves where feed material may accumulate and reduce the turbulence created in the flow of feed material as compared to the turbulence created by dams and serrated and jagged sidewalls.

SUMMARY OF THE INVENTION

An inventive groove design for refiner discs has been invented and is disclosed herein. The grooves are configured to impart a rotational flow, e.g., a vortex, to the feed material flowing longitudinally through the groove. The rotational flow is with respect to an axis extending along at least a portion of the length of the groove. The rotational flow causes the feed material at the lowermost regions of the groove, to move toward the upper regions of the groove, over the ridges of the bars and into a gap between opposing refiner discs. If the rotational flow also causes feed material at the upper regions of a groove to move down into the groove, the rotational flow will quickly move the feed material back to the upper regions. The rotational flow thus repeatedly moves feed material out of and, possibly, into the groove. By imparting a rotation to the flow in a groove, the feed material is quickly moved out of the grooves and does not remain in the groove for extended periods or for extended lengths of the grooves.

The rotational flow in the grooves may be less turbulent than the flows resulting from dams and serrated or jagged sidewalls in a groove. Also, the rotational flow may reduce the eddy currents that can form in grooves immediately upstream of dams and near serrated and jagged sidewalls. Reducing the amount of turbulent flow in grooves and reducing eddy current in grooves should reduce the tendency of feed material becoming trapped at the bottom of grooves and becoming hard obstructions in the grooves.

The grooves are shaped to impart the rotational flow. The grooves may have shapes that are half helical (half of a corkscrew), wherein the helix is halved along its length. The grooves may have a semi-circular or semi-elliptical shape in cross section. The grooves, when viewed in cross section and along the length of the groove, may appear as a truncated disc or a truncated ellipse. The half helical shapes of the groove impart a rotational flow of the feed material flowing through the groove. The rotation of the flow should also assist in moving the feed material over the ridges of the bars as the feed material rises out of the grooves.

To impart rotations to the flow of feed material in the grooves, surfaces of the grooves, such as on sidewalls and at the bottom of the grooves, may include thread-like surface features, e.g., ridges or slots arranged to cause flow rotation. The surface features may appear, when looking down into the grooves, as truncated cones or half-truncated ellipses. The surface features may be ridges or ramps at an oblique angle to the longitudinal axis of each groove. The surface features may extend throughout the surface of the grooves. The surface features may be confined to the leading sidewall of the groove and not be on the trailing sidewall. The surface features may also be confined to upper or lower regions of the sidewall of the grooves and not be on the lower or upper regions of the sidewall. The surface features may extend along the sidewalls of the grooves to the ridge of the bars or may end a certain distance below the ridges.

A refiner disc has been invented comprising: a refining zone on a front face of the disc; refining bars in the refining zone; and grooves between the bars, wherein each of the grooves include a rotational inducement element arranged on at least one sidewall of the groove and the rotational inducement element is configured to impart at helical flow to feed material flowing through the groove.

The cross section of each of the grooves may be bordered by a surface that is curvilinear along a cross section of the groove. For example, the cross section of each of the grooves may be semi-circular or semi-elliptical.

The rotational inducement elements in each of the grooves may each be oriented, along the length of the element, at an oblique angle to an axis of the groove. The oblique angle may be in a range of 35 to 75 degrees.

The rotational inducement elements in a groove may be arranged as a series of repeating ridges extending inward from a wall of the groove, wherein each of the repeating ridges is oriented at an oblique angle to an axis of the groove. The repeating ridges may include a sloped sidewall. The rotation inducement elements in each groove may include a series of narrow regions in the groove formed by sidewalls of the grooves having a wavy pattern along the length of the groove, wherein the wavy pattern on one of the sidewalls is offset from the wavy pattern on the other one of the sidewalls. The height of the rotation inducement element may be greater in a lower half of the grooves than in an upper half of the grooves.

A refiner plate segment has been invented comprising: a refining zone on a front face of the disc segment; refining bars in the refining zone; and grooves between the bars, wherein at least one of the grooves include at least one rotational inducement element arranged on at least one sidewall of the groove and the rotational inducement element is configured to impart at helical flow of feed material flowing through the groove.

BRIEF DESCRIPTION OF THE DRAWINGS

The invention is shown in the exemplary embodiments illustrated in the figures, which are.

DETAILED DESCRIPTION OF THE INVENTION

Figure 1:
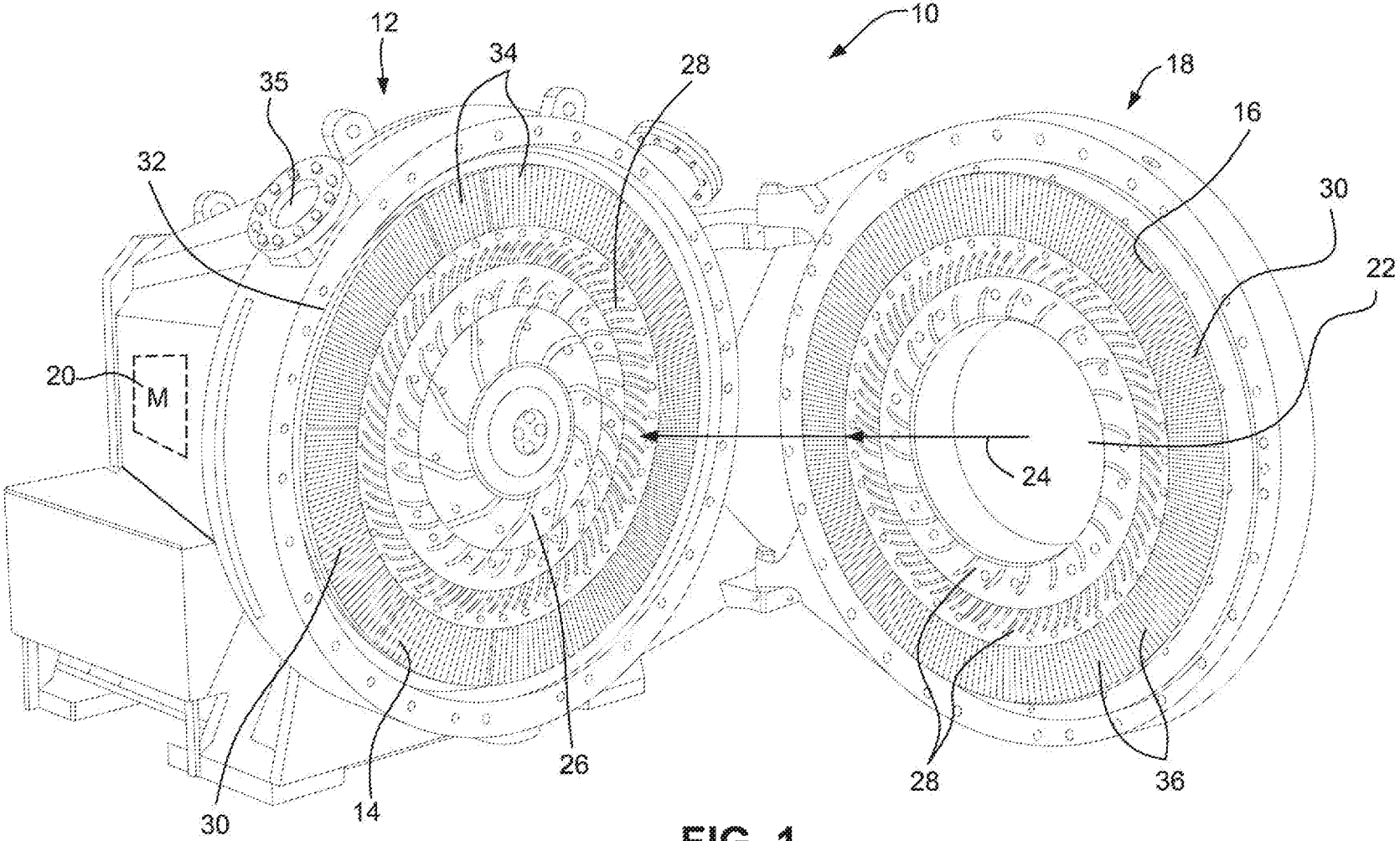
FIG. 1 (PRIOR ART)
FIG. 1 illustrates a conventional refiner with opposing refiner discs.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

References in the specification to "one embodiment," "an embodiment," "an exemplary embodiment," etc., indicate that the embodiment described may include a feature, structure, or characteristic, but every embodiment may not necessarily include the feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

It should be noted that some of the terms used herein are relative terms. For example, the terms "upper" and "lower" are relative to each other in location, i.e. an upper component is located at a higher elevation than a lower component in a given orientation, but these terms can change if the device is flipped. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow of fluids through an upstream component prior to flowing through the downstream component.

The terms "horizontal" and "vertical" are used to indicate direction relative to an absolute reference, i.e. ground level. However, these terms should not be construed to require structure to be absolutely parallel or absolutely perpendicular to each other. For example, a first vertical structure and a second vertical structure are not necessarily parallel to each other. The terms "top" and "bottom" or "base" are used to refer to locations/surfaces where the top is always higher than the bottom/base relative to an absolute reference, i.e. the surface of the Earth. The terms "upwards" and "downwards" are also relative to an absolute reference; an upwards flow is always against the gravity of the Earth.

FIG. 1 shows an exemplary refiner 10 for mechanical refining. Mechanical refining processes include, without limitation, mechanical pulping, thermo-mechanical pulping and chem-thermo-mechanical pulping (collectively referred to as mechanical pulping). Mechanical refining may be used to make pulp to form medium density fiberboard (MDF), particle board, chemical pulp, and high, medium and low consistency pulps.

The refiner 10 is open to show the opposing refiner discs. Within a housing 12 of the refiner are mounted a pair of opposing refiner discs 14, 16. The housing has a door 18 with an inside area that supports one of the refiner discs 16, which may be a stator (stationary) disc. The door 18 is closed (not shown) to move the stator refiner disc 16 into an opposing position with the other refiner disc 14, which may be a rotor disc that rotates and is driven by a motor 20 within the housing or coupled to the housing.

The opposing discs 14, 16 of the refiner 10 may operate at rotational speeds of 900 to 2300 revolutions per minute (RPM) when used for high consistency refining and as low as 400 revolutions per minute for low consistency refining. While the wood chips are between the discs, energy is transferred to the material via refiner plates attached to the discs.

Feed material, such as wood chips or pulp, enter the refiner 10 through a center opening 22 in the door 18 of the housing, after the door is closed. The fed material is turned from an axial flow direction 24 to a generally radial flow direction by a rotating flinger plate 26 which is aligned with the center opening 22 in the door. The flinger plate directs the feed material into a gap between the opposing refiner discs 14, 16.

The refiner discs may include one or more annular rows of breaker bars 28 that break the feed material, such as wood chips, into particles. From the breaker bars 28, the feed material moves radially outward into the refining section of the refiner. The refining section 30 is defined by bars and grooves on the front faces of the rotor and stator discs. The refining section is an annular region between the opposing rotor disc 14 and the stator disc 16. Radially outward of the refining section is a plenum 32 within the housing. Feed material flows from the refining section into the plenum 32 and then out a discharge outlet 35 on the housing 12.

The refiner discs 14, 16 are typically formed as an annular array of refiner plate segments 34, 36. The refiner plate segments are arranged side-by-side on a supporting disc as shown in FIG. 1. The refiner plate segments 34 may be arranged in an annular array to form the refiner disc 14, 16.

The refiner plate segments 34, 36 may be metallic and formed by molding. The molding may include pouring molten metal into a sand mold having recesses conforming to the shape of the refiner plate segment. The sand mold may be formed by additive manufacturing (3D printing) methods.

The refiner plate segments may be generally planar and configured for use in mechanical refiners with planar refining discs. Alternatively, the refiner plane segments may be arched in a cross-section of the segment and configured for use on conical or cylindrical mechanical refiners.

Figure 3:
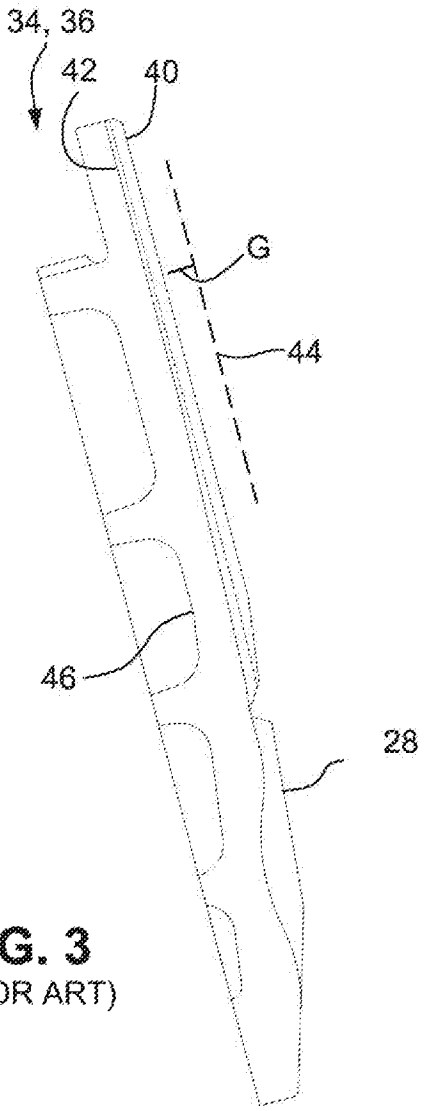
FIG. 3 (PRIOR ART)
FIG. 3 is a side view of the conventional refiner plate segment shown in FIG. 2.
Figure 2:
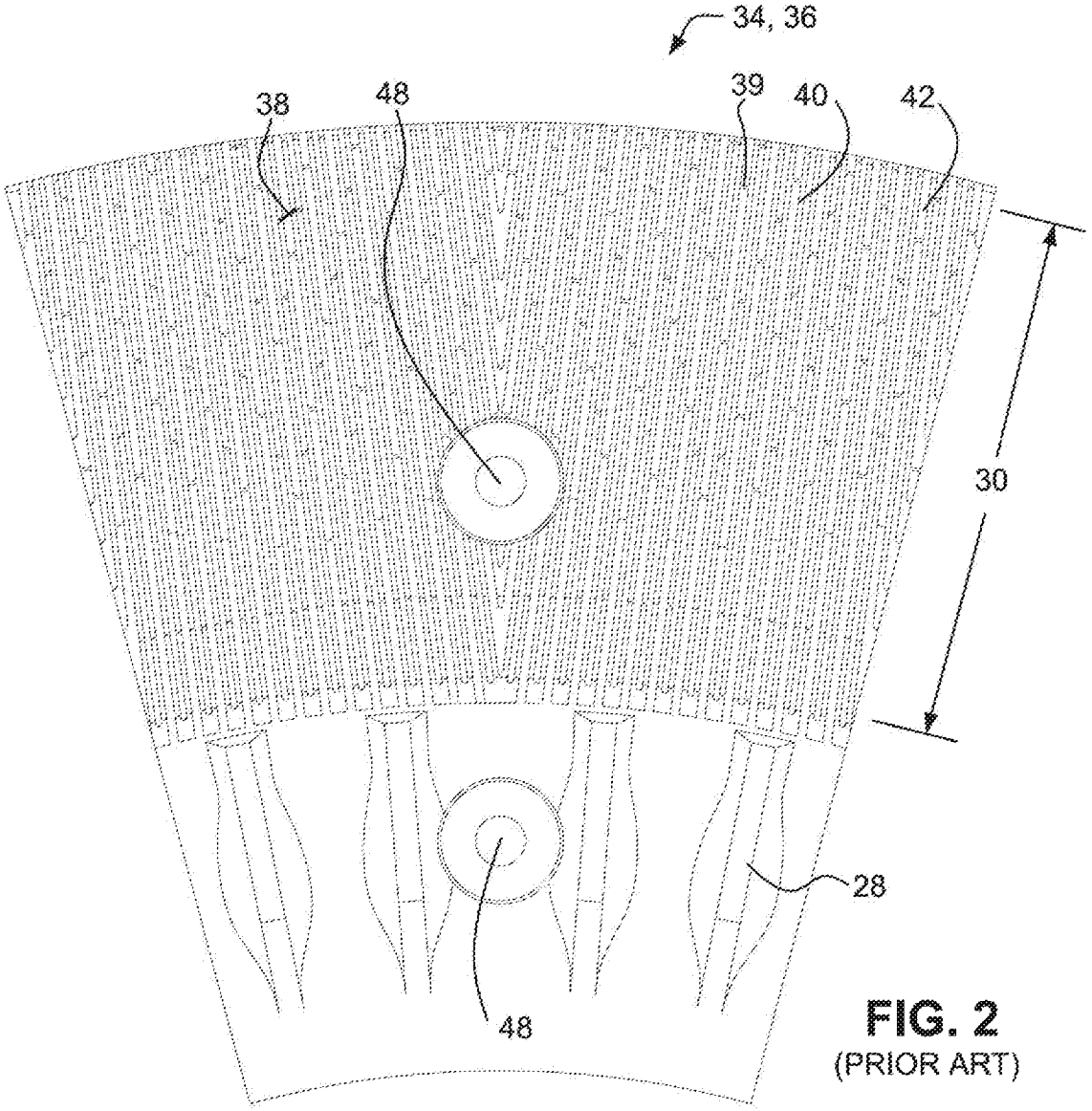
FIG. 2 (PRIOR ART)
FIG. 2 is a front view of a conventional refiner plate segment.

Mechanical refiners include, but are not limited to, refiners to process comminuted cellulosic material, such as wood chips, to produce pulp, and dispersers used to recycle paper. Mechanical refiners typically include at least one set of: opposing discs, such as a pair of opposing planar discs at least one of which rotates, a pair of conically or cylindrically shaped discs at least one of which rotates, and an assembly of parallel flat and conical discs. FIG. 2 shows a front face of a conventional refiner plate segment 34, 36. FIG. 3 is a side view of the conventional refiner plate segment 34, 36. The refiner plate segments 34 for the rotor are typically identical in shape for the entire rotor disc 14. Similarly, the refiner plate segments 36 forming the stator disc 16 are typically identical in shape for the entire stator disc. Also, the refiner plate segments 34, 36 for the stator and rotor discs may also have substantially the same shapes, at least with respect to their front refining surfaces. However, it is common for the refining surfaces, e.g., bars and grooves, for the refining plate segments for the stator to differ from those for the refining plate segments for the rotor.

The refiner plate segments 34, 36, have front faces 38 with the bars 40 and grooves 42 that form the refining section 30. The bars and grooves may extend generally radially along the front face of the refining plate segment. The bars and grooves may be straight as show in FIG. 2 or may be curved. The curvature or angle of the bars and grooves with respect to a radial line may increase or decrease as the radius increases of the bars and grooves. Dams 39, such as full-height or half-height dams, may be in the grooves at one or more locations along the length of the grooves. The dams 39 assist in retarding the flow of material through the refining section and forcing feed material in the grooves out of the grooves and over the ridges of the bars.

The back face 46 of each of the refiner plate segments 34, 36 is configured to be mounted to a supporting disc or other structure in the housing 12 of the refiner. A hole (aperture) 42 may extend through the refiner plate segment. The hole 48 is configured to receive a fastener that fastens the refiner plate segment to the supporting disc. Alternatively, the back of the plates may have threaded holes that allow the plates to be fixed to the refiner disc with bolts from the back side.

The upper ridges of the bars 44 of the refiner plate segments are straight and aligned with a plane of the front face. The ridges of the bars 40 of the refiner plate segments 34 for the rotor are separated by a gap (G) from the ridges of the bars 44 of the opposing refiner plate segments 36 for the stator, while the rotor disc and stator disc are mounted in the housing and the door of the housing is closed. Feed material flows through the gap (G) as the feed material moves is a generally radial direction between the opposing rotor and stator discs 14, 16.

The opposing refining sections 30 of the rotor and stator discs 14, 16 refine the feed material moving through the gap (G) between the discs. As the opposing discs 14, 16 rotate, the bars 40 of one disc cross and uncross, and thereby repeatedly compress and shear the feed material in the gap (G). The compressions and shearing separate the feed material into lignocellulosic fibers. The fiber separation is a step in transforming wood chips into pulp suitable board or paper making fiber component.

The compressions and shear forces are greatest in the gap (G) between the ridges of bars 40 on opposing discs 14, 16. Fiber separation is most effective when all or nearly all of the feed material is in the gap (G) and repeatedly moves over the ridges of the bars as the bars cross each other. Fiber separation is less effective if some of the feed material remains in the grooves for a substantial portion of the period that the material moves in the gap (G) between the refining sections 30.

Figure 4:
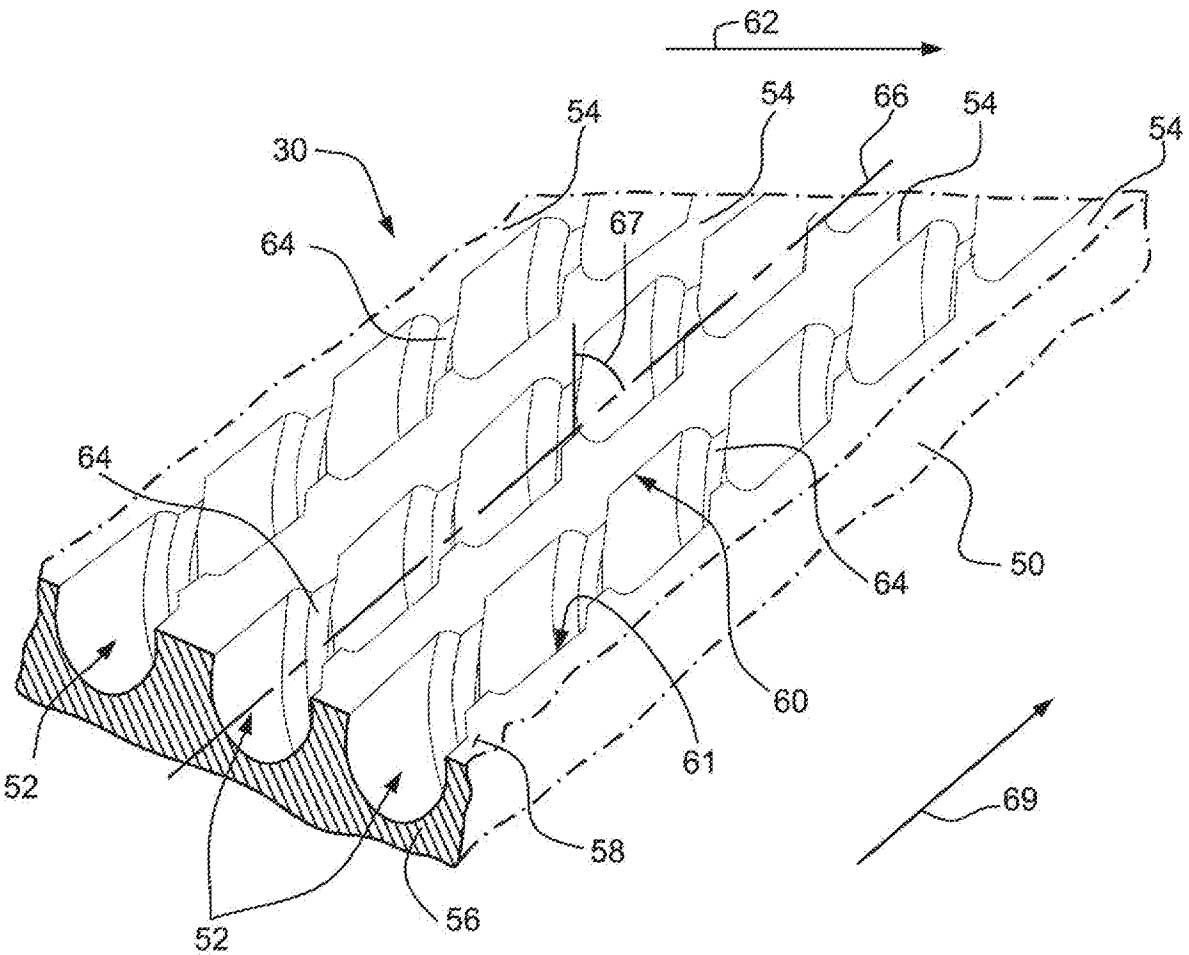
FIG. 4 is a perspective view of the top of a refining section of a refiner plate segment that embodies the invention of grooves.

FIG. 4 is a perspective view of the top of a refining section 30 of a refiner plate segment 52 that embodies the invention of grooves 52 that impart rotation to the material flowing through the grooves. The grooves 52 are formed by the side walls of bars 54 on opposite sides of each of the grooves. The grooves 52 extend down into the refiner plate segment. Below the grooves is a substrate region 56 of the refiner plate segment which is a region, e.g., generally planar, between the bottom of the grooves and the back face 46 of the segment. The grooves 52 are substantially parallel, e.g., with two to five degrees of being parallel, to each other and to the bars 54. The grooves 52 and bars 54 may extend from a radially inward edge of the refining section 30 to a radially outer edge. Alternatively, the grooves and bars may be arranged in refining annular sub-sections within the refining section 30. For example, the grooves and bars may become narrower from one sub-section to a radially outward sub-section.

The grooves 52 may be generally semi-circular in cross section as shown in FIG. 4. The cross-sectional shape of the grooves may be one-half or less than one-half of a circle such that the groove is widest at the ridge (top) 58. Alternatively, and as shown in FIG. 4, the cross-sectional shape of the grooves 52 may be greater than one half of a circle such that the groove is widest in a plane between the ridge 58 of the bars and the bottom of the grooves.

If the cross sectional shape is greater than one-half of a circle, the ridges 58 of the bars have a greater thicknesses than a portion of the bars immediately below the ridge. Because the bars become thinner below the ridge, the leading edge 60 and/or trailing edges 61 of the bars at the ridges are sharpened by the greater than 90 degree angle between the ridge and the sidewall of the bar. A leading edge 60 of the bar faces a direction 62 of relative rotation between the discs 14, 16 including the bar and the opposing disc. Similarly, the trailing edge 61 of the bar faces away from the direction 62 of relative rotation. Having a sharp edge, especially at the leading edges 60 of the bars, may be advantageous in cutting feed material and separating fibers from the feed material.

The circular cross sectional shape of the grooves 52 assists in allowing a rotational flow, e.g., a vortex, of feed material through the grooves. The cross section of the groove may be circular or some other continuously curved surface or a curvilinear line formed of either all curved surfaces or a combination of curved and straight line surfaces. The circular cross section allows the flow to rotate in a helical motion. The circular cross section also does not have corners where the bottom of the groove meets the sidewall of a bar. The lack of corners reduces the risk that eddy currents will form in such corners. Eddy currents can trap fibers of the feed material and form a fiber and solid material buildup that tends to clog the grooves.

A rotation inducement element 64 is within each of the grooves 52, or may be in just a plurality of the grooves 52. The rotation inducement element is configured to induce at least partially rotational flow of the feed material in the groove. The rotation inducement element 64 is configured to cause the feed material within the groove to move in a flow path that is at least partially helical about a longitudinal axis 66 of the groove 52.

The rotation inducement element 64 may be configured to induce rotation of the feed material in the groove such that the feed material moves in a generally at least partially helical path, e.g., corkscrew path, from the bottom of the groove up along the sidewall of the bar with the leading edge and into the gap (G) between the opposing discs. The rotation inducement element 64 extends along the length of the groove or at least a portion of the length, such as at regular intervals along the length of the groove. By having the rotation inducement element 64 along the length of the groove, the rotational flow is induced along the length of the groove. In one embodiment, the rotation inducement element is a series of semi-helical ridges as shown in FIG. 4.

A function of the rotation inducement element 64 is to induce a rotational flow of feed material within the groove that moves feed material from the bottom of the groove to the top of the groove and into the gap (G) between the discs 14, 16. To impart rotations flow in the grooves, surfaces of the grooves, such as on sidewalls and at the bottom of the grooves, may include thread-like surface features arranged to cause flow rotation. The surface features appear when looking down into the grooves as truncated cones or half-truncated ellipses. The surface features may be ridges or ramps at an oblique angle to the longitudinal axis of each groove. The surface features may extend throughout the surface of the grooves. Or the surface features may be confined to the leading sidewall of the groove and not be on the trailing sidewall. The surface features may also be confined to upper or lower regions of the sidewall of the grooves and not be on the lower or upper regions of the sidewall. The surface features may extend along the sidewalls of the grooves to the ridge of the bars or may end a certain distance below the ridges.

Figure 5:
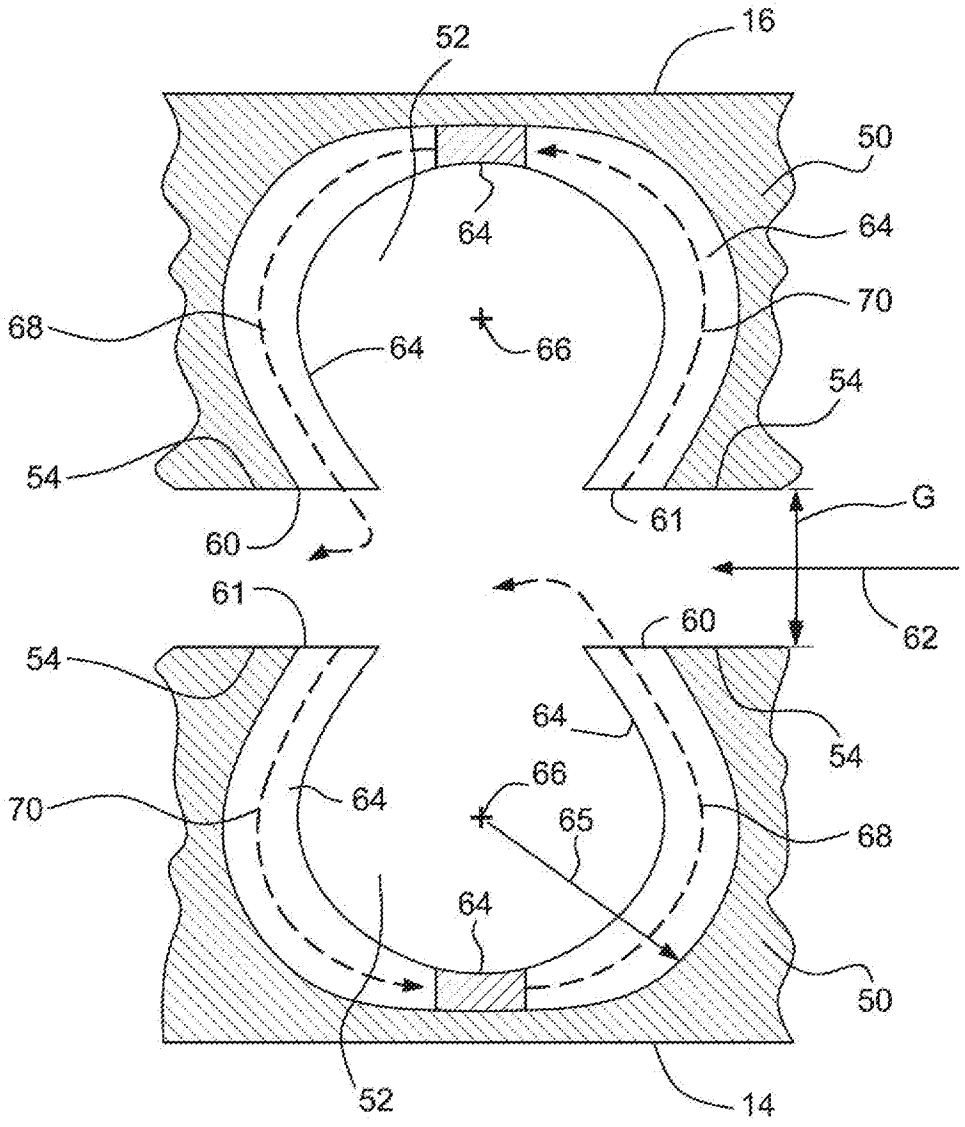
FIG. 5 is a schematic diagram of a cross section of a pair of grooves in opposing refiner plate segments.

FIG. 5 is a schematic diagram of a cross section of a pair of grooves 52 in opposing refiner plate segments 50 wherein one plate segment is mounted on a rotor disc 14 and the other is mounted to a stator disc 16. The front faces of the plate segments are separated by a gap (G) when mounted to the discs in the housing of the refiner. The grooves are semi-circular in cross section and each have a longitudinal axis. The rotation inducement element 64 in each groove may be a semi-helical ridges as shown in FIG. 4.

In the embodiment shown in FIG. 5, the rotation inducement element 64 is a series of semi-helical ridges on the sidewalls of the grooves which are formed by the bars adjacent the groove. Each of the semi-helical ridges is a ridge extending along a portion of the sidewalls. Each semi-helical ridge is aligned with a plane that is oblique to the axis 66 of the groove. The angle of the plane may be selected to achieve a desired flow characteristic of the feed material through the groove. The angle may be, for example, between 25 degrees to 85 degrees, such as 35 to 75 degrees; 25 to 65 degrees, 35 to 55 degrees or be at 45 degrees.

The semi-helical ridge rotation inducement element 64 shown in FIG. 4 may include a leading sidewall, a ridge (apex) and a trailing sidewall. The leading sidewall faces the flow direction of feed material moving through the groove and the trailing sidewall faces away from the flow direction. The leading sidewall and/or the trailing sidewall may be sloped, such as a gradually increasing slope, from the sidewall of the bar forming the groove to the ridge of the rotation inducement element. The ridge is the radially inward-most region of the rotation inducement element. The ridge may a width that is greater than the height of the ridge from the sidewall of the bars.

The height of the semi-helical ridge of the rotation inducement element is from the sidewall to the apex of the ridge of the bar. The height may be in a range of 0.2 to 0.7 the diameter 65 of the groove, or 0.3 to 0.6; 0.4 to 0.5 the diameter of the groove. In some areas of the refiner plate, the height of the ridges may be such that the ridges completely closes off the groove so as to form a bridge over the groove.

The semi-helical ridges of the rotation inducement element 64 is at an oblique angle 67 with the axis 66 of the groove 52. The oblique angle 67 may be in a range(s) of 25 to 75 degrees, 35 to 65 degrees, 40 to 55 degrees or 45 degrees. The oblique angle 67 may be oriented such that the rotation inducement element 64 spirals down the trailing sidewall of the groove and/or up the leading sidewall of the groove in a flow direction 69 of the feed material through the groove. This orientation should assist is moving the feed material through the groove along the flow direction 69.

The extent to which the semi-helical ridge extends around the entirety of a cross sectional view of the groove may be selected to achieve desired flow characteristics of the feed material in the groove and based on other design factors for the groove.

The helical flow of feed material in each of the grooves is represented by dotted line arrows. A first arrow 68 represents the flow of feed material from the bottom of the groove to the top of the groove. As shown by first arrow 68, the feed material flows up and over the leading edge 60 of the groove and into the gap (G) between the refiner plate segments. While in the gap (G), the feed material that is between the ridges of the bars 54 are subjected to the stronger compression and shear forces that the feed material in the grooves. The second arrow 70 illustrates helical flow of feed material from an upper region of the groove, such as near a trailing edge 61 of an adjacent bar, and down into the groove.

The feed material is pushed through the groove by the centrifugal force of the rotation of at least one of the discs. The rotation inducement element 64 turns the flow of material from a direction generally parallel to the longitudinal axis 66 of the groove to a flow path direction that is at least semi-helical with respect to the axis.

The rotational flow of the feed material is induced by the shape of the rotation inducement element in the groove. For example, if the rotation inducement element is a semi-helical ridge, such as shown in FIGS. 4 and 5, the leading wall of the ridge guides the movement of the feed material as the material flows through the groove. As the feed material flows through the groove, the leading wall of the semi-helical rotation inducement element 64 turns the feed material flowing near the sidewalls of the bars forming the groove.

Figure 6:
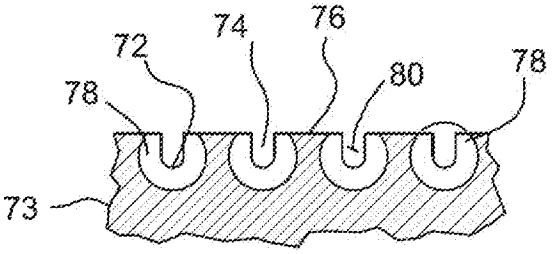
Figure 7:
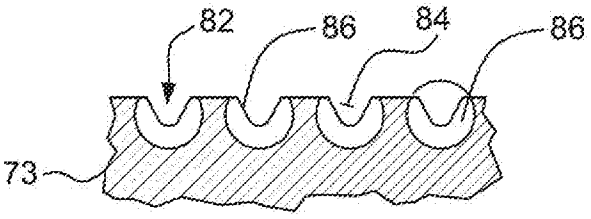
Figure 8:
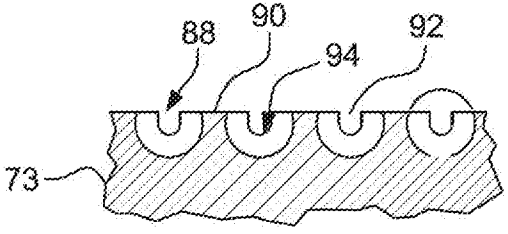

FIGS. 6, 7 and 8 show in cross section different types of rotational inducement elements in a groove of a refiner plate segment. The circle in the groove on the far right in FIGS. 6, 7 and 8 illustrates that the groove is semi-circular in cross section. The rotation inducement elements shown in FIGS. 6, 7 and 8 are semi-helical ridges, similar to the rotation inducement element 64 shown in FIG. 4.

In FIG. 6, the groove 72 is relatively deep into the refiner plate segment 73 such that the axis 74 of the groove 72 is well below the ridges 76 of the bars. The groove 72 is semi-circular in cross section wherein the circumference of the cross section of the groove is in a range of 65% to 85% of a full circle.

The rotation inducement element 78 in FIG. 6 has a generally uniform height from the sidewall of the groove except near the upper portion of the groove where the height reduces as the rotation inducement element 78 approaches the ridge 76. The reduction in the height of the rotation inducement element in FIG. 6 creates a relatively large U-shaped open path 80 formed by the apex of the rotation inducement element 78. The large U-shaped open path 80 extends the length of the groove. The bottom (apex) of the U-shaped open path may be aligned with the axis 74 of the groove 72. The relatively large open path 80 provides an open passage for feed material flowing through the center of the groove and thereby reduces the restriction on the flow of feed material through the groove.

FIG. 7 shows a portion of a refiner plate segment 73 having bars and grooves in a refining zone, wherein the groove 82 is circular in cross section and has an axis (see axis 66 in FIG. 5) that may be aligned with an apex of a V-shaped open path 84 through the groove. The V-shaped open path is defined by the apexes of a rotation inducement element 86. The V-shape open path is a relatively wide path through the groove to allow feed material to flow through the groove.

The rotation inducement element 86 in FIG. 7 has a substantially greater height in the bottom half of the groove 82 as compared to the top half of the groove. The height (H) of the rotation reduction element 86 is the distance from the sidewall or bottom of the groove to the apex of the element. The height of the rotation reduction element 86 may be reduced gradually from its full height in the bottom half of the groove to one-half of the full height to zero height. For example, the height of the groove at the edge of the ridge 76 may be one-half the full height, one-third, one-quarter or zero of the full height, and any height between these values. Reducing the height of the rotation inducement element as dramatically as shown in FIG. 7 creates the wide V-shaped open path through the groove.

FIG. 8 shows a portion of a refiner plate segment 73 having grooves 88 that are shallower in the refiner plate segment than the grooves shown in FIGS. 6 and 7. The shallower grooves 88 result in narrow ridges 90 of the bars as compared to the ridges 76 shown in FIG. 6. The shallower groove 88 and the rotation inducement element 94 define a U-shaped open path 92 that has a smaller cross-sectional area than the U-shaped open path 80 shown in FIG. 6. The apex of the U-shaped open path 92 is aligned with an axis of the groove 88. Further, the perimeter of the semi-circular cross-sectional shape of the grooves 88 extends in a range of 40% to 65% of a full circle. This range is below the range of the deeper grooves 72 shown in FIG. 6.

The depth of a groove is typically determined as a distance from the substrate of the plate segment, e.g., the bottom of the groove, to the upper most height of the adjacent ridges along the length of the groove. The height of the ridges may or may not vary along the length of the ridge.

The height of each ridge at each point along the length of the ridge need not be defined by the depth of the grooves.

The height of the ridges may also be selected depending on the amount of flow rotation that is desired to be imparted by the grooves and based on steam or fluid flow quantity through the grooves. For example, the ridges may be taller than the radius of the groove section, up to and including being a complete blocker of the groove.

Figure 9:
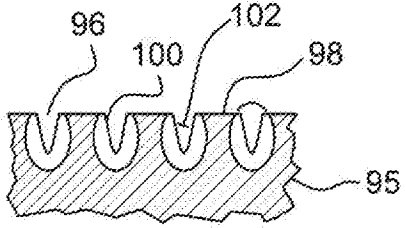
FIGS. 6 to 11 show in cross section different types of rotational inducement elements in a groove of a refiner plate segment.
Figure 10:
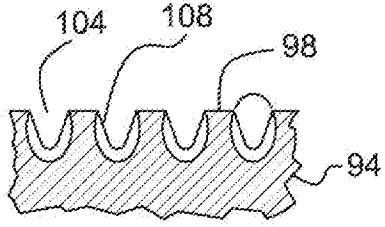
Figure 11:
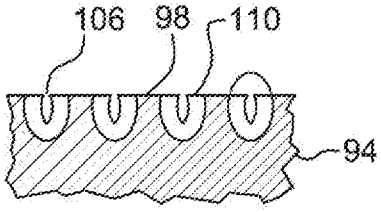

FIGS. 9 to 11 show in cross section a portion of a refiner plate segment 95 having grooves that are semi-elliptical in cross section, as indicated by the ellipse in the right most groove in the figures.

The shape and depth of the grooves may be selected to have a desired cross-sectional area of the groove. In FIG. 0.9, the groove 96 is narrow and deep into the refiner plate segment. The bars 98 between the grooves are tall and narrow. The rotation inducement element 100 may be a series of semi-helical ridges extending from the sidewall of the grooves, similar to the rotation inducement element shown in FIG. 4. The apexes of the rotation inducement elements are configured to form a V-shaped open path 102 through the groove. The width, depth and shape of the V-shaped open path and the rotation inducement elements 100 that form the path may be selected to form an open path having a desired cross-sectional area and shape.

As shown in FIG. 10, the grooves 104 are semi-elliptical and configured such that the groove is wide at the ridges of the bars 98. The wide of the opening at the upper region of the grooves 104 in FIG. 10 and grooves 106 in FIG. 11 may be 100% to 80% of the minor axis of the ellipse. By way of comparison, the width of the opening of the groove 96 in FIG. 9 may be 80% to 60% of the minor axis. The width of the opening of the upper region of the grooves may be selected based on, for example, a desired cross sectional area of an open path through the groove.

The rotation inducement element 108 in FIG. 10 has a shorter height than the rotation inducement element 110 in FIG. 11. A short height rotation inducement element 108 allows for a large open passage through the groove which has relatively low flow obstruction to the flow of feed material. A short height rotation inducement element 108 imparts some rotation to the flow of feed material, especially to the flow near the walls of the groove. The height of the rotation inducement element should be sufficient to impart rotation to the flow that moves feed material from the bottom of the groove to the top and out of the groove. Heights of the rotation inducement elements may be 10% to 45% of the axis of a groove having a circular cross section or of a major axis of a groove having an elliptical cross section.

A rotation inducement element having a large height, such as 50% to 100%, 70% to 80% or 80% to 100%, of the distance from the groove side wall to the axis of a groove. A rotational element having a height that covers 100% if the distance to the groove axis is effectively a partial height or full height dam in the groove, wherein the dam is oriented oblique to the groove axis. A groove with a large height may be used to slow the flow of feed material through the groove and strongly induce rotation in the flow of feed material.

The height of the rotational elements may vary along the length of the groove. For example, the height of the rotational element(s) at radially inward portions of the groove may be greater than the height of rotational element(s) at radially outward portions of the groove. Further, the height of the rotational elements may gradually decrease in a radially outward direction of the groove.

Figure 12:
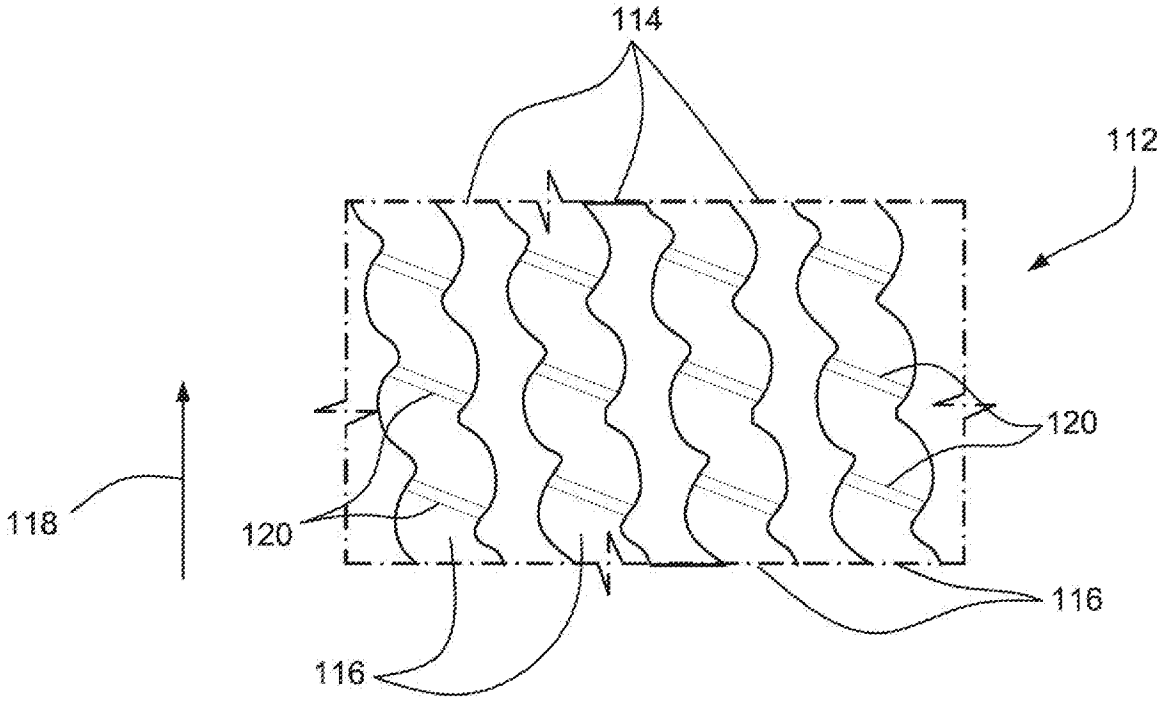
FIG. 12 is a top down view of a schematic diagram of grooves and bars with sidewalls that are wavy, such as sinusoidal.

FIG. 12 shows a top down view of a portion of a refining zone of a refiner plate segment 112. The bars 114 and grooves 116 have sidewalls that vary such as in a sinusoidal pattern. Feed material flows in a direction 118 that is radially outward of the discs on which the refiner plate segment is mounted. The sinusoidal pattern, e.g., wavy pattern, of one of the sidewalls, such as a leading sidewall, may be advanced along the direction 118 with respect to the sinusoidal pattern of the other sidewall, such as the trailing sidewall.

Rotation inducement elements 120 are arranged in the grooves at, for example, regular intervals only the length of the grooves. The rotation inducement elements 120 may be semi-helical ridges extending from the sidewalls and bottom of the grooves. The grooves 116 may be circular or elliptical in cross section. The rotation inducement elements 120 may be at the narrowest regions of the grooves and may formed by cupped shaped surfaces of the sidewalls and bottom of the grooves in the regions between the narrowest regions.

The sinusoidal pattern of the sidewalls and/or bottom of the grooves 116 imparts rotation to the flow of feed material through the grooves. As the feed material approaches a narrow region in the groove, e.g., the rotation inducement element 120, the feed material is turned by the walls of the groove to flow upwards from the bottom of the grooves. This upward flow movement is repeated at each of the rotational inducement elements.

Figure 13:
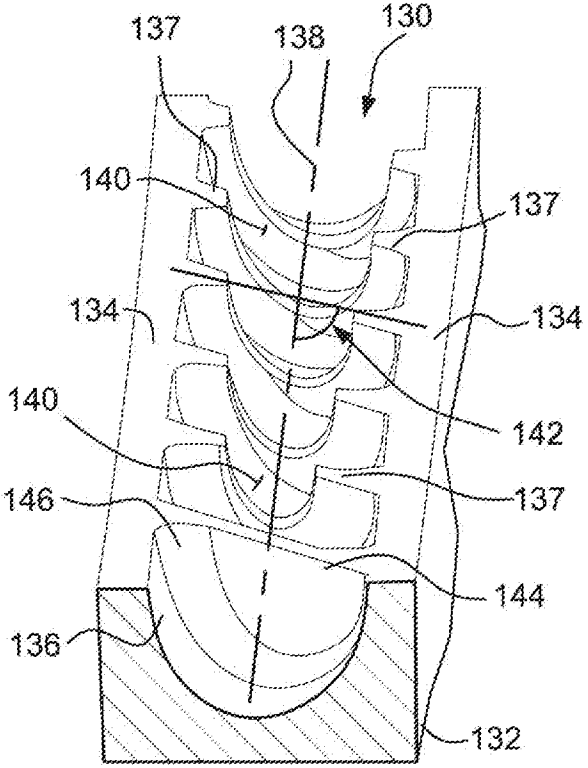
FIG. 13 is a perspective view of a single groove in a refiner plate segment having another embodiment of rotational elements.

FIG. 13 shows an individual groove 130 in a portion of a refiner plate segment 132. The groove 130 is formed between adjacent bars 134. The sidewall 136 of the groove is a half-circle in cross section. An axis 138 of the semi-circular groove is aligned with the ridges of the bars 134. In different embodiments, the axis 138 may be moved to be lower or higher in the groove or above groove. Changing the position of the axis should change the cross-sectional shape of the groove such as from a half-circle to a C-shape in which the open end of the groove is narrower than the widest portion of the groove.

The rotational elements are a series of ridges each extending from the sidewall 136 towards the axis 138 of the groove. Each rotational element 137 is oblique to the axis 138 of the groove. For example, each rotational element is a ridge aligned with a plane 140 at an angle 142 with the axis 138 of 85 to 55 degrees, 80 to 65 degrees, 75 to 45 degrees, for example, the angle 142 of the rotational elements may be constant along the length of a groove. Alternatively, the angle 142 of rotational elements may vary along the length of the groove. For example, the angle 142 may change gradually along the length such as by varying ten degrees from a radially inward end of the groove to a radially outward end of the groove.

The height of the rotational elements 137 may vary along the length of the groove. In the example shown in FIG. 13, the radially inward rotational element(s) 144 entirely span the groove such that the element 144 is a dam oriented at an oblique angle to the axis 138 of the groove. The dam may be positioned at or near a radially outward end of the groove.

The height of the rotational elements 146 may become gradually greater along a radially outward direction of the groove. Thus, an open area 140 between a ridge of the rotational element and the axis of the groove becomes increasingly smaller in the radially outward direction of the groove. Reducing the open area 140 over the groove gradually increases, along the radially outward direction, the resistance to the movement of feed material through the groove.

The rotational elements 137 may each have a fillet 146 between the sidewall 136 and at least a radially inward front side of the rotational element. The fillet is a curved surface extending from the sidewall to a planer portion of the front side the rotational element. For relatively short rotational elements, the curved surface of the fillet 146 may extend to the ridge of the rotational element. The fillet adds structural support to the rotational element and assists in moving feed material near the sidewall from the sidewall and into upper regions of the groove.

Figure 14:
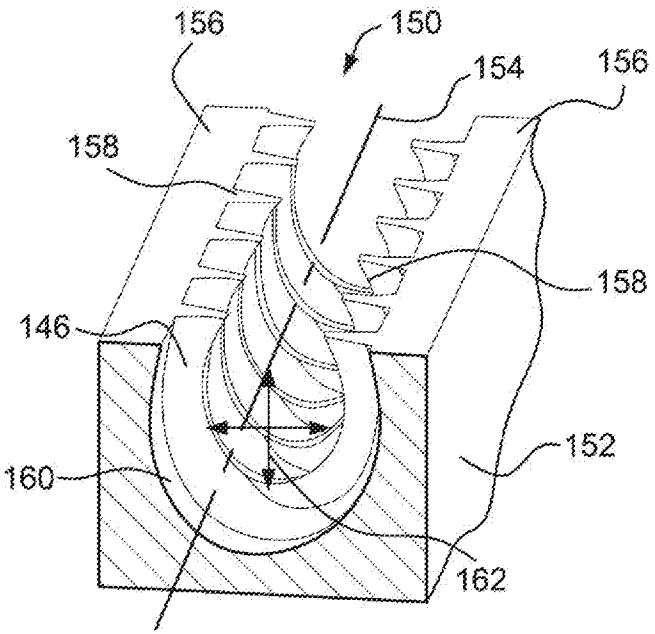
FIG. 14 is a perspective view of a single groove in a refiner plate segment having a further embodiment of rotational elements.

FIG. 14 illustrates another embodiment of a groove 150 in a refiner plane segment 152. The groove is circular or C-shaped in cross section. The axis 154 of the groove 150 is below the ridges of the bars 156 on opposite sides of the groove. The opening of the groove at the ridge of the bars is narrower than the maximum width of the groove. The ridges of the bar are relatively wide as compared to the width of the bars of a groove having an axis aligned with the ridge of the bars, as is evident by comparing FIGS. 14 and 13. Positioning the axis 154 below ridges of the bars allows the groove to have a larger cross sectional area as compared to grooves with the axis at or above the ridge of the bars.

The rotational elements 158 are C-shaped ridges extending from the sidewall 160 of the groove towards the axis 154. The heights of the rotational elements 158 are relatively short, e.g., less than 50%, of the distance between the sidewall 160 to the axis 154. Due to the short rotational elements, an open area 162 (represented by cross with arrows) in the plane of each rotational element is relatively large. The large open areas 162 allows for material to flow freely through the groove. The short rotational elements provide relatively little resistance to the flow, as compared to dams and rotational elements with heights reaching the axis of the groove.

The rotational elements 158 are aligned with a plane oblique to the axis 154 of the groove. Oblique rotational elements act on the material flowing through the groove near the sidewall 160 to impart a rotational flow to the material. The rotational flow causes material in the lower region of the groove, such as near the sidewall, to move up and out of the groove.

An exemplary refiner disc comprises: a refining zone on a front face of the disc; refining bars in the refining zone; grooves between the bars, and at least one rotational inducement element in at least one of the grooves, wherein the at least one rotational inducement element is arranged on or in at least one sidewall of the at least one groove and the at least one rotational inducement element is configured to impart at helical flow of feed material flowing through the at least one groove.

In certain exemplary embodiments of the refiner disc, a curvilinear surface borders each of the grooves in cross section. In further exemplary embodiments of the refiner disc, the cross section of each of the grooves is semi-circular or semi-elliptical. In certain exemplary embodiments of the refiner disc, the at least one rotational inducement element in each of the grooves is oriented at an oblique angle to an axis of the groove. In further exemplary embodiments of the refiner disc, the oblique angle is in a range of 35 to 75 degrees.

In certain exemplary embodiments of the refiner disc, the at least one rotational inducement element includes a series of repeating ridges extending inward from a wall of the groove. In further exemplary embodiments of the refiner disc, each of the repeating ridges is oriented at an oblique angle to an axis of the groove. In further exemplary embodiments of the refiner disc, each of the repeating ridges includes a sloped sidewall. In certain exemplary embodiments of the refiner disc, the disc includes an annular array of plate segments and each of the plate segments includes a front face with a portion of the refining zone.

In certain exemplary embodiments of the refiner disc, the at least one rotation inducement element includes a series of narrow regions in the groove formed by sidewalls of the grooves having a wavy pattern along the length of the groove, wherein the wavy pattern on one of the sidewalls is offset from the wavy pattern on the other one of the sidewalls. In certain exemplary embodiments of the refiner disc, a height of the at least one rotation inducement element is greater in a lower half of the grooves as compared to a height of the at least one rotational inducement element in an upper half of the grooves.

In certain exemplary embodiments of the refiner disc, the at least one rotational element is a series of rotational elements in the groove, and a height of the rotational elements increases in a radially outward direction of the groove. In certain exemplary embodiments of the refiner disc, the at least one rotational element includes a rotational element that forms a full-height dam which is oriented obliquely to an axis of the groove. An exemplary refiner plate segment comprises: a refining zone on a front face of the disc segment; refining bars in the refining zone; grooves between the bars, and at least one rotational inducement element in at least one of the grooves, wherein the at least one rotational inducement element is arranged on or in at least one sidewall of the at least one groove and the at least one rotational inducement element is configured to impart at helical flow of feed material flowing through the at least one groove.

In certain exemplary embodiments of the refiner plate segment, a plurality of the grooves have a curvilinear surface in cross section. In certain exemplary embodiments of the refiner plate segment, a plurality the grooves have a surface which semi-circular or semi-elliptical in cross section.

In certain exemplary embodiments of the refiner plate segment, the at least one rotational inducement element in each of the grooves is oriented at an oblique angle to an axis of the groove. In further exemplary embodiments of the refiner plate segment, the oblique angle is in a range of 35 to 55 degrees.

In certain exemplary embodiments of the refiner plate segment, a height of the at least one rotation inducement element is greater in a lower half of the grooves as compared to a height of the at least one rotational inducement element in an upper half of the grooves. In certain exemplary embodiments of the refiner plate segment, the at least one rotational inducement element includes a series of repeating ridges extending inward from a wall of the groove. In further exemplary embodiments of the refiner plate segment, each of the repeating ridges is oriented at an oblique angle to an axis of the groove. In yet further exemplary embodiments of the refiner plate segment, each of the repeating ridges includes a sloped sidewall extending along the grooves to the ridge of the bars or may end a certain distance below the ridges.

In certain exemplary embodiments of the refiner plate segment, wherein the at least one rotation inducement element is a series of narrow regions in the groove formed by sidewalls of the grooves having a wavy pattern along the length of the groove, wherein the wavy pattern on one of the sidewalls is offset from the wavy pattern on the other one of the sidewalls. In certain exemplary embodiments of the refiner plate segment, the at least one rotational element is a series of rotational elements in the groove, and a height of the rotational elements in the series progressively increases in a radially outward direction of the groove.

An exemplary method to refine feed material includes: introducing the feed material into a gap between opposing refiner discs, wherein at least one of the refiner discs includes: a refining zone on a front face of the disc; refining bars in the refining zone; grooves between the bars, and at least one rotational inducement element in at least one of the grooves, wherein the at least one rotational inducement element is arranged on or in at least one of the grooves; rotating at least one of the opposing refiner discs; inducing a rotational flow to the feed material flowing through the at least one groove due to an interaction between the feed material and the at least one rotational inducement element; refining the feed material flowing through the gap, and discharging refined feed material from the gap between the opposing refiner discs.

In certain exemplary methods, a curvilinear surface borders each of the grooves in cross section. In certain exemplary methods, the cross section of each of the grooves is semi-circular or semi-elliptical. In certain exemplary methods, the at least one rotational inducement element in each of the grooves is oriented at an oblique angle to an axis of the groove. In further exemplary methods, an oblique angle of a refiner plate of a refiner disc is in a range of 35 to 75 degrees.

In certain exemplary methods, the at least one rotational inducement element includes a series of repeating ridges extending inward from a wall of the groove. In further exemplary methods, each of the repeating ridges is oriented at an oblique angle to an axis of the groove. In yet further exemplary methods, each of the repeating ridges includes a sloped sidewall.

In certain exemplary methods, the disc includes an annular array of plate segments and each of the plate segments includes a front face with a portion of the refining zone. In certain exemplary methods, the at least one rotation inducement element includes a series of narrow regions in the groove formed by sidewalls of the grooves having a wavy pattern along the length of the groove, wherein the wavy pattern on one of the sidewalls is offset from the wavy pattern on the other one of the sidewalls.

In certain exemplary methods, a height of the at least one rotation inducement element is greater in a lower half of the grooves as compared to a height of the at least one rotational inducement element in an upper half of the grooves. In certain exemplary methods, the at least one rotational element is a series of rotational elements in the groove, and a height of the rotational elements increases in a radially outward direction of the groove. In certain exemplary methods, the at least one rotational element includes a rotational element that forms a full-height dam which is oriented obliquely to an axis of the groove While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

What is claimed is:

1. A refiner disc comprising:

a refining zone on a front face of the refiner disc;

refining bars in the refining zone;

grooves between the bars, and at least one rotational inducement element in at least one groove, wherein the at least one rotational inducement element is a semi-helical element comprising a leading sidewall, a ridge, and a trailing sidewall, the at least one rotational inducement element configured to impart a helical flow to feed material flowing through the at least one groove, wherein the at least one rotational inducement element is arranged on at least one sidewall of the at least one groove.

2. The refiner disc of claim 1, wherein a curvilinear surface borders each of the grooves in cross section.

3. The refiner disc of claim 2, wherein a cross section of each of the grooves is semicircular or semi-elliptical.

4. The refiner disc of claim 1, wherein the at least one rotational inducement element in each of the grooves is oriented at an oblique angle to an axis of the at least one groove.

5. The refiner disc of claim 4, wherein the oblique angle is in a range of 35 to 75 degrees.

6. The refiner disc of claim 1, wherein the at least one rotational inducement element includes a series of repeating ridges extending inward from a wall of the at least one groove.

7. The refiner disc of claim 6, wherein each of the repeating ridges is oriented at an oblique angle to an axis of the at least one groove.

8. The refiner disc of claim 6, wherein each of the repeating ridges includes a sloped sidewall.

9. The refiner disc of claim 1, wherein the refiner disc includes an annular array of plate segments and each of the plate segments includes a front face with a portion of the refining zone.

10. The refiner disc of claim 1, wherein the at least one rotation inducement element includes a series of narrow regions in the at least one groove formed by sidewalls of the grooves having a wavy pattern along a length of the at least one groove, wherein the wavy pattern on one of the sidewalls is offset from the wavy pattern on another one of the sidewalls.

11. The refiner disc of claim 1, wherein a height of the at least one rotation inducement element is greater in a lower half of the grooves as compared to a height of the at least one rotational inducement element in an upper half of the grooves.

12. The refiner disc of claim 1, wherein the at least one rotational inducement element is a series of rotational elements in the at least one groove, and a height of the rotational inducement elements increases in a radially outward direction of the at least one groove.

13. The refiner disc of claim 1, wherein the at least one rotational inducement element includes a rotational element that forms a full-height dam which is oriented obliquely to an axis of the at least one groove.

14. A refiner plate segment comprising:

a refining zone on a front face of the refiner plate segment;

refining bars in the refining zone;

grooves between the bars, and at least one rotational inducement element in at least one groove, wherein the at least one rotational inducement element is a semi-helical element comprising a leading sidewall, a ridge, and a trailing sidewall, the at least one rotational inducement element configured to impart a helical flow to feed material flowing through the at least one groove wherein the at least one rotational inducement element is arranged on at least one sidewall of the at least one groove.

15. The refiner plate segment of claim 14, wherein a plurality of the grooves have a curvilinear surface in cross section.

16. The refiner plate segment of claim 14, wherein a plurality the grooves have a surface which semi-circular or semi-elliptical in cross section.

17. The refiner plate segment of claim 14, wherein the at least one rotational inducement element in each of the grooves is oriented at an oblique angle to an axis of the at least one groove.

18. The refiner plate segment of claim 17, wherein the oblique angle is in a range of 35 to 55 degrees.

19. The refiner plate segment of claim 14, wherein a height of the at least one rotation inducement element is greater in a lower half of the grooves as compared to a height of the at least one rotational inducement element in an upper half of the grooves.

20. The refiner plate segment of claim 14, wherein the at least one rotational inducement element includes a series of repeating ridges extending inward from a wall of the at least one groove.

21. The refiner plate segment of claim 20, wherein each of the repeating ridges is oriented at an oblique angle to an axis of the at least one groove.

22. The refiner plate segment of claim 20, wherein each of the repeating ridges includes a sloped sidewall extending along the grooves to a ridge of the refining bars.

23. The refiner plate segment of claim 14, wherein the at least one rotation inducement element is a series of narrow regions in the at least one groove formed by sidewalls of the grooves having a wavy pattern along a length of the at least one groove, wherein the wavy pattern on one of the sidewalls is offset from the wavy pattern on another one of the sidewalls.

24. The refiner plate segment of claim 14, wherein the at least one rotational inducement element is a series of rotational elements in the at least one groove, and a height of the rotational inducement elements in the series progressively increases in a radially outward direction of the at least one groove.

25. A method to refine feed material including:

introducing the feed material into a gap between opposing refiner discs, wherein at least one refiner disc includes:

a refining zone on a front face of the at least one refiner disc;

refining bars in the refining zone;

grooves between the bars; and at least one rotational inducement element in at least groove, wherein the at least one rotational inducement element is a semi-helical element comprising a leading sidewall, a ridge, and a trailing sidewall, the at least one rotational inducement element configured to impart a helical flow to feed material flowing through the at least one groove, wherein the at least one rotational inducement element is arranged on at least one sidewall of the at least one groove;

rotating at least one of the opposing refiner discs;

inducing a rotational flow to the feed material flowing through the at least one groove due to an interaction between the feed material and the at least one rotational inducement element;

refining the feed material flowing through the gap; and discharging refined feed material from the gap between the opposing refiner discs.

26. The method of claim 25, wherein a curvilinear surface borders each of the grooves in cross section.

27. The method of claim 25, wherein a cross section of each of the grooves is semicircular or semi-elliptical.

28. The method of claim 25, wherein the at least one rotational inducement element in each of the grooves is oriented at an oblique angle to an axis of the at least one groove.

29. The method of claim 28, wherein an oblique angle is in a range of 35 to 75 degrees.

30. The method of claim 25, wherein the at least one rotational inducement element includes a series of repeating ridges extending inward from a wall of the at least one groove.

31. The method of claim 30, wherein each of the repeating ridges is oriented at an oblique angle to an axis of the at least one groove.

32. The method of claim 30, wherein each of the repeating ridges includes a sloped sidewall.

33. The method of claim 25, wherein the at least one refiner disc includes an annular array of plate segments and each of the plate segments includes a front face with a portion of the refining zone.

34. The method of claim 25, wherein the at least one rotation inducement element includes a series of narrow regions in the at least one groove formed by sidewalls of the grooves having a wavy pattern along a length of the at least one groove, wherein the wavy pattern on one of the sidewalls is offset from the wavy pattern on another one of the sidewalls.

35. The method of claim 25, wherein a height of the at least one rotation inducement element is greater in a lower half of the grooves as compared to a height of the at least one rotational inducement element in an upper half of the grooves.

36. The method of claim 25, wherein the at least one rotational inducement element is a series of rotational elements in the at least one groove, and a height of the rotational inducement elements increases in a radially outward direction of the at least one groove.

37. The method of claim 25, wherein the at least one rotational inducement element includes a rotational element that forms a full-height dam which is oriented obliquely to an axis of the at least one groove.

* * * * *